US012601575B2

(12) United States Patent
Williams et al.

(10) Patent No.: US 12,601,575 B2
(45) Date of Patent: Apr. 14, 2026

(54) RANGE EXTENSION DEVICE

(71) Applicant: BAE SYSTEMS PLC, London (GB)

(72) Inventors: Andrew David Williams, Monmouth (GB); Benjamin Daniel Worrall, Monmouth (GB); Thomas William Tyrell, Monmouth (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 19/112,077

(22) PCT Filed: Sep. 11, 2023

(86) PCT No.: PCT/GB2023/052347
§ 371 (c)(1),
(2) Date: Mar. 14, 2025

(87) PCT Pub. No.: WO2024/057000
PCT Pub. Date: Mar. 21, 2024

(65) Prior Publication Data

US 2025/0383188 A1 Dec. 18, 2025

(30) Foreign Application Priority Data

Sep. 14, 2022 (GB) ..... 2213428

(51) Int. Cl.
*F42B 10/40* (2006.01)
*F42B 10/44* (2006.01)

(52) U.S. Cl.
CPC ..... *F42B 10/40* (2013.01); *F42B 10/44* (2013.01)

(58) Field of Classification Search
CPC ..... F42B 10/32; F42B 10/38; F42B 10/40; F42B 10/42; F42B 10/44
(Continued)

(56) References Cited

U.S. PATENT DOCUMENTS 4,213,393 A * 7/1980 Gunners ..... F42B 10/40 102/374
4,807,532 A * 2/1989 Andersson ..... F42B 10/40 102/490
(Continued)

FOREIGN PATENT DOCUMENTS

DE 102018115072 A1 12/2019
GB 2319593 A * 5/1998 ..... F42B 10/40
(Continued)

OTHER PUBLICATIONS

International Search Report and Written Opinion received for PCT/GB2023/052347. Mail Date: Nov. 20, 2023. 10 pages.
(Continued)

*Primary Examiner* — James S Bergin
(74) *Attorney, Agent, or Firm* — Arcane Law PLLC

(57) ABSTRACT

The present invention relates to a range extension device, particularly to a reversible range extension device, especially reversible base bleed device.
There is provided a reversible range extension device, capable in use, of being reversibly engaged to a body of an artillery shell, said range extension device comprising at least one energetic material, and an igniter, wherein the range extension device comprises a first end with an aperture, and second closed end, wherein the range extension device, in use, is selectively arranged to be in an active orientation or inert orientation, wherein in the active orientation the range extension device is arranged such that the aperture faces rearwardly away from the shell to allow the range extension device to function, and in the inert orientation the range extension device is arranged such that the aperture faces inwardly towards the shell.

20 Claims, 5 Drawing Sheets

(58) Field of Classification Search
USPC ..... 102/490
See application file for complete search history.

(56) References Cited

U.S. PATENT DOCUMENTS

| | | | | |
|---|---|---|---|---|
| 4,807,535 | A * | 2/1989 | Schilling | F42B 10/40 102/490 |
| 4,846,071 | A * | 7/1989 | Franzen | F42B 10/40 102/490 |
| 4,930,420 | A * | 6/1990 | Meffert | F42B 15/00 102/490 |
| 7,578,238 | B1 | 8/2009 | Dabiri | |
| 10,900,761 | B2 | 1/2021 | Blanche et al. | |

FOREIGN PATENT DOCUMENTS

| | | | | |
|---|---|---|---|---|
| GB | 2622383 | A * | 3/2024 | F42B 10/40 |
| WO | WO2024057000 | A1 | 3/2024 | |

OTHER PUBLICATIONS

Search Report received for GB Application No. 2213428.2, dated Mar. 9, 2023. 3 pages.

* cited by examiner

RANGE EXTENSION DEVICE

FIELD

The present invention relates to a range extension device, particularly to a reversible range extension device, especially reversible base bleed device.

BACKGROUND

It is known to increase the range of fire for artillery shells, by generation of a mass flow in the near wake zone, known as base flow or base bleed. It is further known to use rocket assist motors on artillery shells to greatly enhance the range of a shell.

According to a first aspect of the invention there is provided a reversible range extension device, capable in use, of being reversibly engaged to a body of an artillery shell, said range extension device comprising at least one energetic material, and an igniter, wherein the range extension device comprises a first end with an aperture, and second end which is a closed end, wherein the range extension device, in use, is selectively arranged to be in an active orientation or inert orientation, wherein in the active orientation the range extension device is arranged such that the aperture faces rearwardly away from the shell to allow the range extension device to function, and in the inert orientation the range extension device is arranged such that the aperture faces inwardly towards the shell.

The range extension device may be selected from a rocket assist or base bleed device, preferably a base bleed. Base bleed devices are well known devices, which are filled with an energetic material typically selected from a gas generator. They are ignited and are designed to infill, with gas, the vacuum created behind the shell as it traverses along its trajectory. The base bleed provides little to no thrust, it simply reduces drag of the shell by reducing the vacuum, thereby extending the range overall shell.

The range extender body may be manufactured from any suitable high strength material such as, for example high-strength tempered steel, titanium, fibre reinforced composites or aluminium alloys.

The reversible engagement may be any quick release mechanism that allows the range extension device to be reversibly coupled to the shell body. The reversible engagement may be a thread, bayonet fitting, pins, highly preferably there are co-operative threads on the range extension device and the shell body.

In a preferred arrangement the range extension device may be located in a housing, wherein the housing is reversibly attached or fixedly attached, in use, to the shell body, and wherein the range extension device may be selectively positioned ie reversibly engaged within the housing in the inert or active orientation. The reversible engagement between the housing and the range extension device may be any quick release mechanism that allows the range extension device to be reversibly coupled to the housing. The reversible engagement may be a thread, bayonet fitting, pins, highly preferably there are co-operative threads on the range extension device and the housing.

The first end comprises an aperture, such an aperture may be a simple hole in the first end, a choke, nozzle or any means of controlling the flow of the gas from the energetic material within the range extension device.

The second end is a closed end of the range extension device, which provides a gas tight closure, such that when the base bleed device is in the inert orientation, the gas generator may not function or be caused to be ignited. The range extension device preferably is a cylindrical housing having a base which forms the closed end and a cylindrical wall, which provide a gas tight enclosure. The cylindrical housing of the range is gas tight such that all of the generated gas, when caused to function only exits via the aperture in the first end.

The closed end may have any shaped or profiled end, preferably a drag reducing geometry, more preferably a boat tail. As an example, the shell may be transported to a forward operating base, with a housing pre-installed on the shell, the operator may then decide whether the range extension module is required to be in the active or inert orientation, depending on the range that is required. The user may then have a base bleed option, a rocket assist option, and the boat tail is always present on the closed end of both of the range extension options, thereby reducing the need to also carry a third option, ie boat tail. Alternatively, the shell at the forward operating base, may be stored with range extension device positioned in the inert orientation to protect the base bleed device, so as to provide a safety feature. During use, the operator may then decide whether to use a base bleed or boat tail depending on the range required.

There is provided a reversible base bleed device, capable in use of being reversibly engaged to a body of an artillery shell, said base bleed device comprising at least one energetic material charge, and an igniter, wherein the base bleed device comprises a first end with an aperture, and second closed end, wherein the base bleed device in an active orientation has the aperture facing rearwardly away from the shell to allow the base bleed to function, and an inert orientation, has the aperture facing inwardly towards the shell, to provide a boat tail.

According to a second aspect of the invention, there is provided an artillery shell comprising a shell body, a fuze and located therebetween an ogive portion, said shell body and ogive section capable of receiving a payload, wherein at rearward of the shell body is a housing, comprising a reversibly engaged range extension device as defined herein; preferably the range extension device is located in a housing, wherein the housing is reversibly attached to the shell body, and wherein the range extension device is selectively positioned within the housing in the inert or active orientation.

The shell may be a common carrier shell, capable of receiving multiple types of payload, such as for example, it may be selected for different tasks, for example as explosive, illumination, smoke, electronic and UAV payloads. The provision of a modular tail device, ie the reversible range extension device, provides flexibility of range, as well as payload selection. The ability to remove the range extension device and/or the housing, allows for the payload to be loaded from the rear of the munition.

The weapon barrels may be dimensioned in different sizes, the range extension devices may be fitted to medium or large calibre shells, 20-40 mm, or 100-155 mm, respectively.

The invention therefore allows the range of a projectile to be changed on site at short notice. The reversible range extension device when placed in the inert orientation will mitigate any inadvertent activation of the base bleed.

Attempts to merely cover up the aperture of the open end with a closure device, when subjected to violent set back, high temperature, hot gases and particulates from the shell's propellant, could leak past an aperture cover. Clearly with the aperture, when in the inert position, there is a much reduced chance of sympathetic ignition, as the ignitor for the range extender and the energetic material are facing away from the main propellant charge gases, and further separated by the reversible connector which would provide a gas-tight seal. Whilst accidental ignition of a range extender may not be dangerous, it may dramatically change the planned and selected range of the shell.

The prior art systems, typically require specific shell bodies to receive a boat tail, base bleed, or a rocket assist. It is clear that the mass of each of the options will be different, and so for each prior art system, each option will change the mass of the final shell. In the system according to the invention the mass of the range extension device, whether in the inert or active position has the same mass. This reduces further complexities in accounting for change of mass of the shell, for range calculations.

BRIEF DESCRIPTION OF THE FIGURES

Embodiments of the invention will now be described by way of example only with reference to the figures, in which.

DETAILED DESCRIPTION

Figure 1:
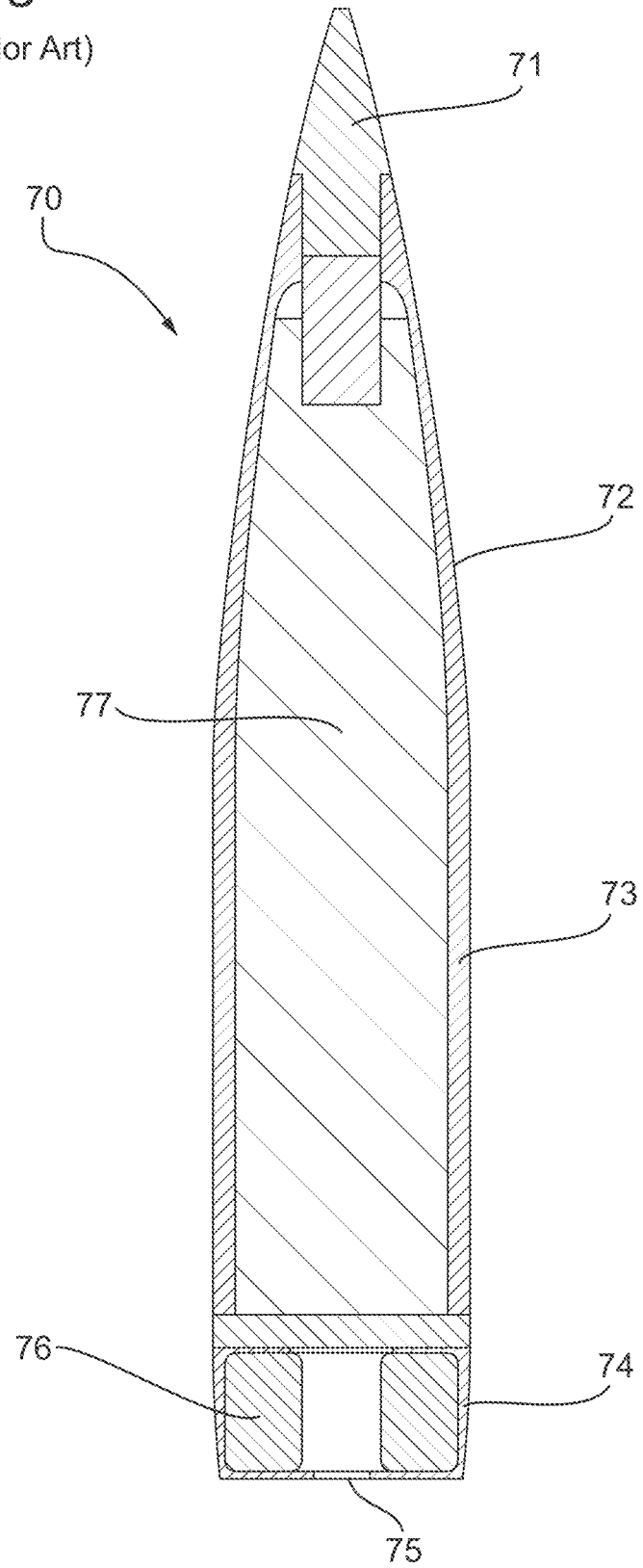
Fig. 1 (Prior Art)
FIG. 1 shows a prior art base bleed device.

Turning to FIG. 1, shows a prior art base bleed shell 70. The shell body 72 and base bleed 74 are a unitary body, which cannot be separated into component parts, to leave a shell capable of being reassembled at a forward operating site, so as to be fired. The base bleed 74 comprises a gas generating composition 76, which when ignited exits via the plenum chamber 75, to provide an infill of gas flow to the vacuum created behind the shell when flying. The shell 72 cannot be reversibly detached from the base bleed 74, so there is no means to swap over the payload 77. The shell payload 77 is therefore fixed at the point of manufacture. The shell cannot be converted to a standard range munition, once the shell is launched the base bleed will function to extend the range.

Figure 2:
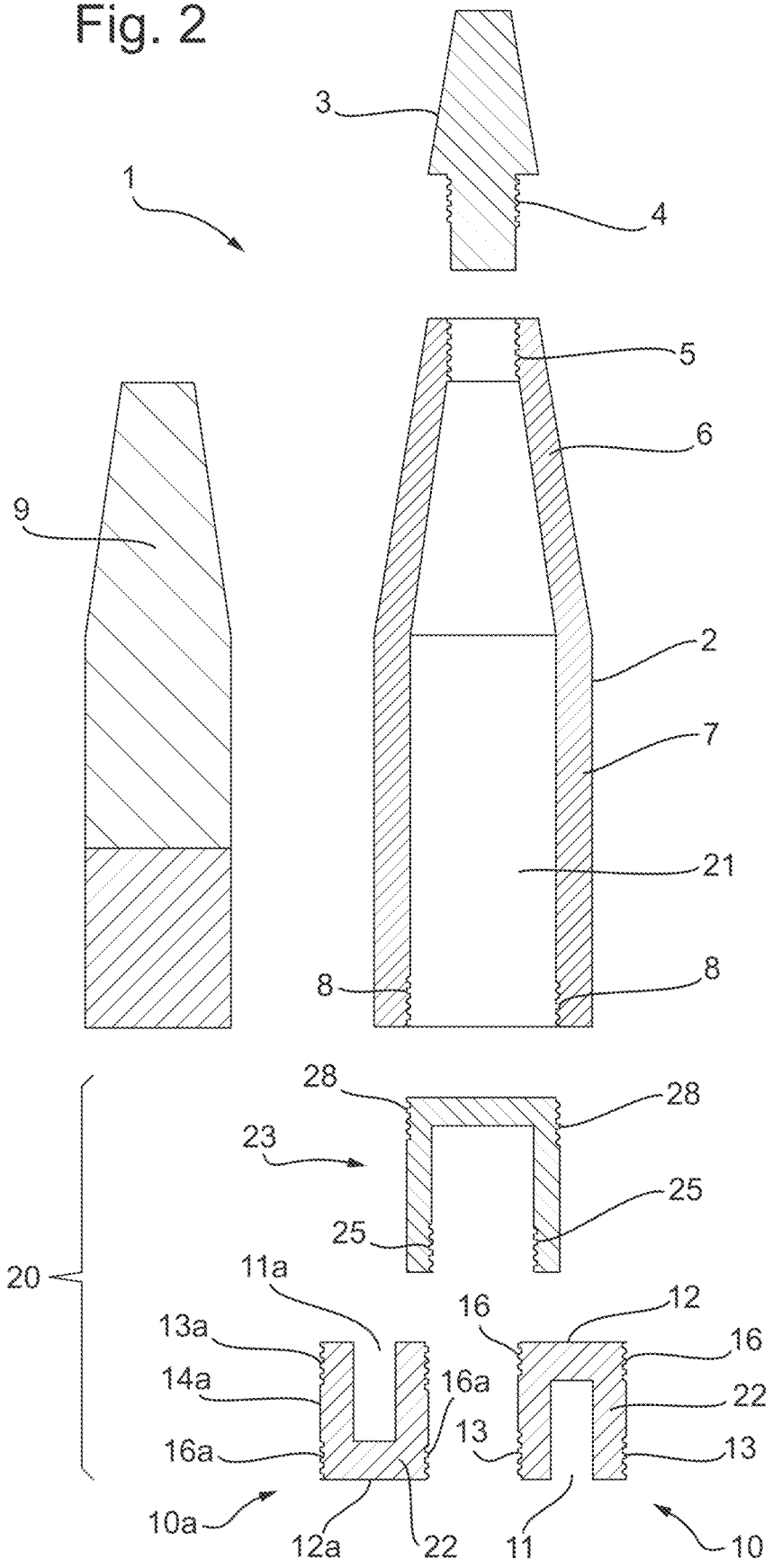
FIG. 2 shows the reversible base bleed device according to the invention.

Turning to FIG. 2 shows a common carrier shell 1, with a shell body 2, fuze 3, and reversible range extension device 20. The shell body 2, comprises an ogive portion 6, which may be part of a unitary shell body as shown, or a split shell (not shown). The ogive portion 6 and main body 7 form the shell body 2, with an empty cavity 21. The empty cavity 21 is filled with a payload 9, which can be a high explosive fill, illumination, smoke, electronic, UAV, or any other desired payload. The payload 9 may be inserted into the empty cavity 21 from the rear of the shell body 2.

At the front end of the shell, the fuze 3 typically comprises a threaded portion 4, which engages with the threaded portion 5 on the front end of the shell.

The reversible range extension device 20, comprises a base bleed device 10, 10*a*, the base bleed device may be in the inert orientation 10*a* or the active orientation 10. In the inert orientation 10*a*, the closed end 12*a*, is located towards the main propellant charge not shown, the closed end 12*a*, may be a boat tail shape. The open end 11*a*, is reversibly attached by a reversible attachment means in the form of threads 13*a* to the threads 35 on the housing 30. Alternatively the threads 13*a* may be directly attached to the shell threads 8.

In the active orientation 10, the closed end 12, is located towards the shell body 8, such that the open end 11 is directed towards the main propellant charge not shown. Thereby upon ignition of the main charge propellant, the hot gases and particulates will cause the ignition of the base bleed composition 22. Alternatively the base bleed device 22 may have its own ignitor (not shown).

The closed end 12, is reversibly attached by a reversible attachment means in the form of threads 16 to the threads 35 on the housing 30. Alternatively the threads 16 may be directly attached to the shell threads 8.

Figure 3:
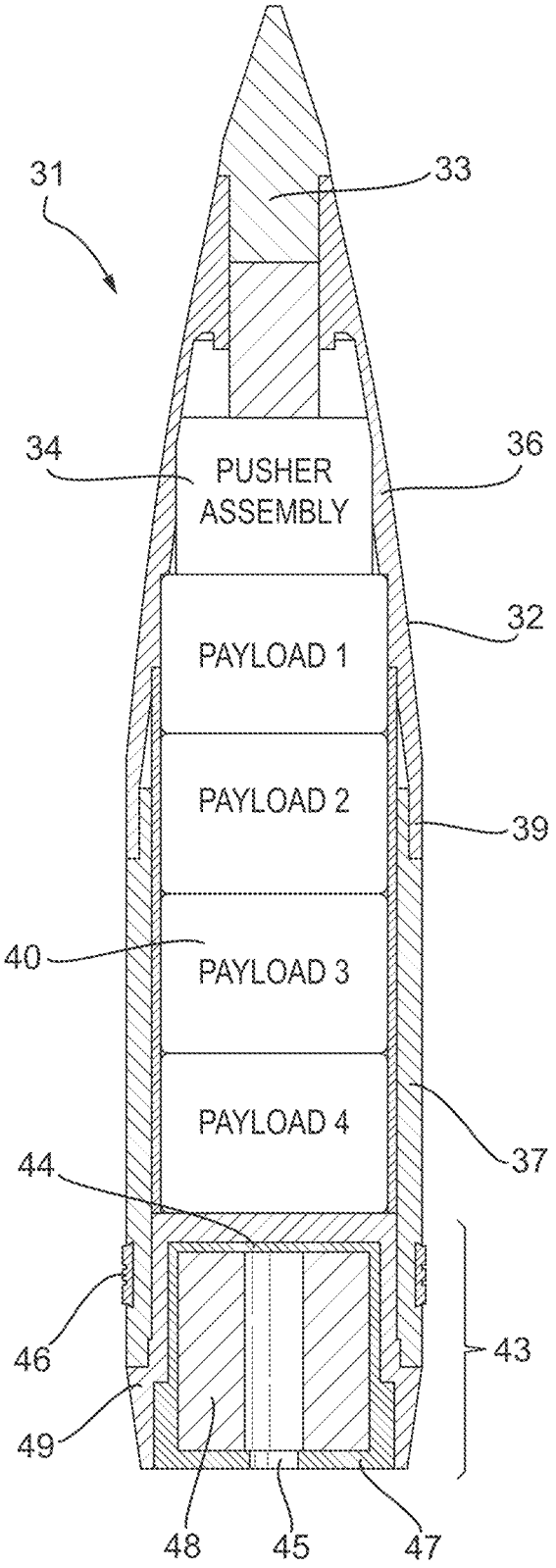
FIG. 3 shows a filled shell with a base bleed device.
Figure 4:
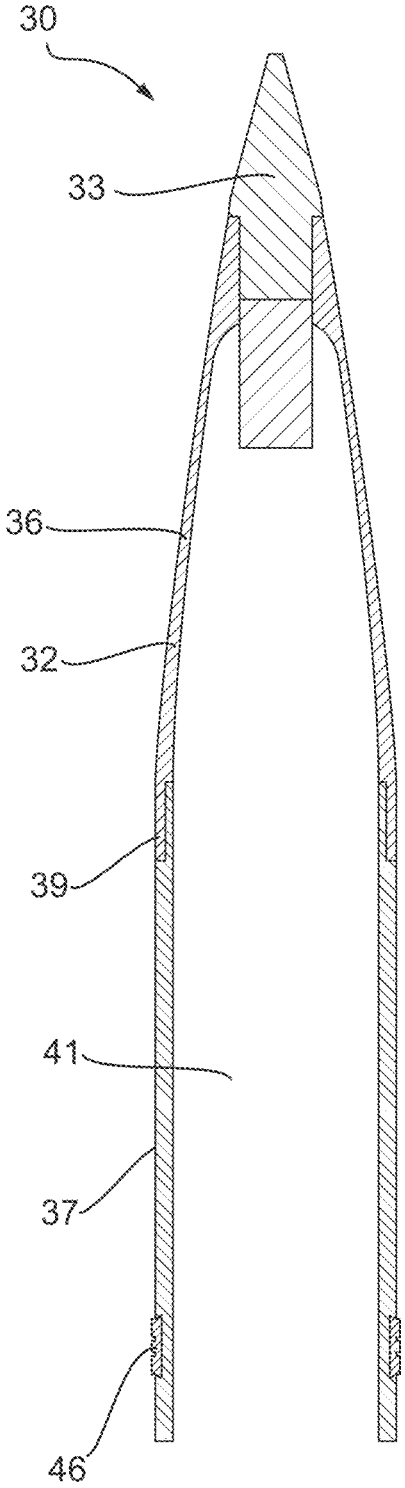
FIG. 4 shows an empty shell with payload cavity.

Turning to FIGS. 3 and 4 show a base bleed in a loaded (engaged) form 31 in a shell body 32. The empty common carrier shell 30, shows the empty payload cavity 41. The shells 30, 31 comprise a shell body 32, fuze 33, and a reversibly engaged range extension device 43. The shell body 32 is a split shell, comprising an ogive portion 36, which has a screw thread 39 to join with the main body 37. The ogive portion 36 and main body 37 form the shell body 32, forming the empty payload cavity 41 therein. The empty cavity 41 is filled with modular payloads (1 to 4) 40, which may be incremental high explosive fills, or a number of modular illumination, smoke, electronic, UAV, or any other desired payloads, (alternatively a unitary payload may be used). The modular payload 40, may be inserted into the empty cavity 41 from the rear of the shell body 32, typically the modular payload may for ease of insertion be in a liner, which slides into the empty cavity. For payloads 40 such as illumination or smoke the fuze 33 may initiate an expulsion charge (pusher assembly) 34 to force the payload 40 out of the rear of the shell cavity 41.

The reversibly engaged range extension device 43, comprises a housing 49 and located therein a reversible base bleed device 47. The base bleed device 47 being shown in the active orientation.

The aperture 45 of the first end of base bleed device 47 is directed rearwardly towards the main propellant charge (not shown). Thereby upon ignition of the main charge propellant, the hot gases and particulates may cause the ignition of the base bleed composition 48. Alternatively the base bleed device 47 may have its own ignitor (not shown).

The base bleed composition 48 comprises a uniform cavity to ensure a consistent burn. The closed end 42 of second end of the base bleed device 47, is located towards and sits inside the housing 49.

The driving band 46 is located towards the rear of the shell body 32, so as to impart spin to the shell upon gun launch.

Figure 5:
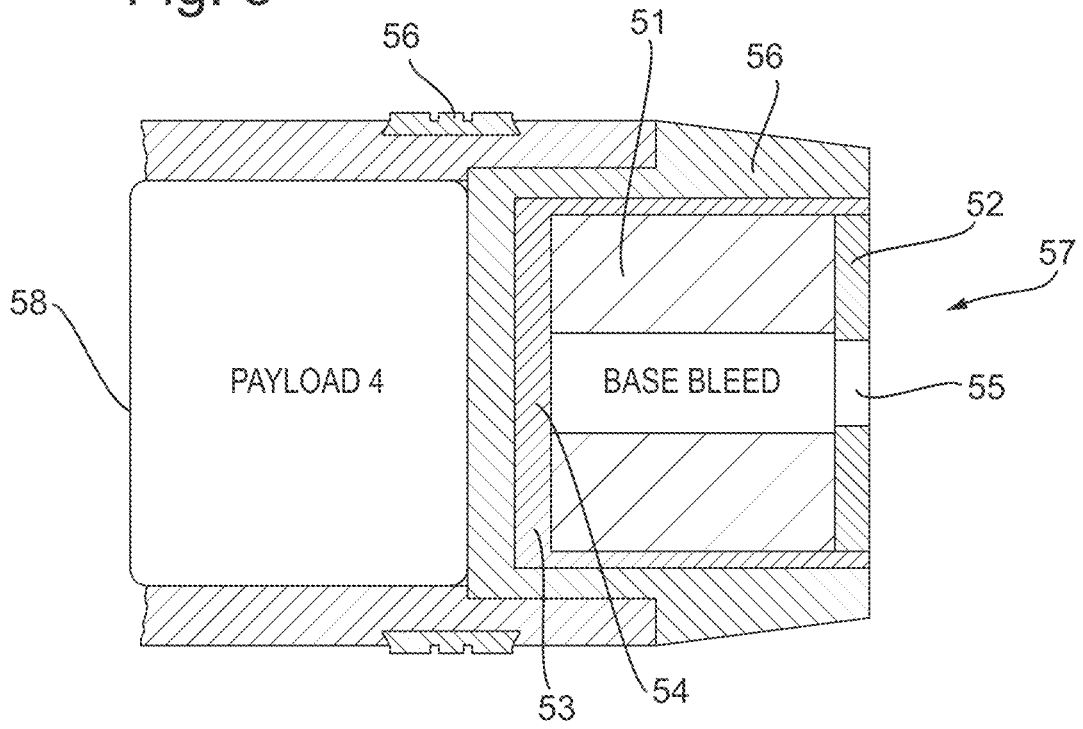
FIG. 5 show the base bleed in the active configuration

Turning to FIG. 5 there is a section of the rear of the shell 58 with a modular payload, showing the base bleed unit 57 in the housing 56 in the active orientation.

The first end 52 of base bleed device 57 comprises an aperture 55 which is directed rearwardly towards the main propellant charge (not shown). Thereby upon ignition of the main charge propellant, the hot gases and particulates may cause the ignition of the base bleed composition 51. Alternatively the base bleed device 47 may have its own ignitor (not shown). The closed end 54, of the second end 53) is then facing inwardly to the shell body and payload 58.

The driving band 46 is located towards the rear of the shell body, so as to impart spin to the shell upon gun launch.

Figure 6:
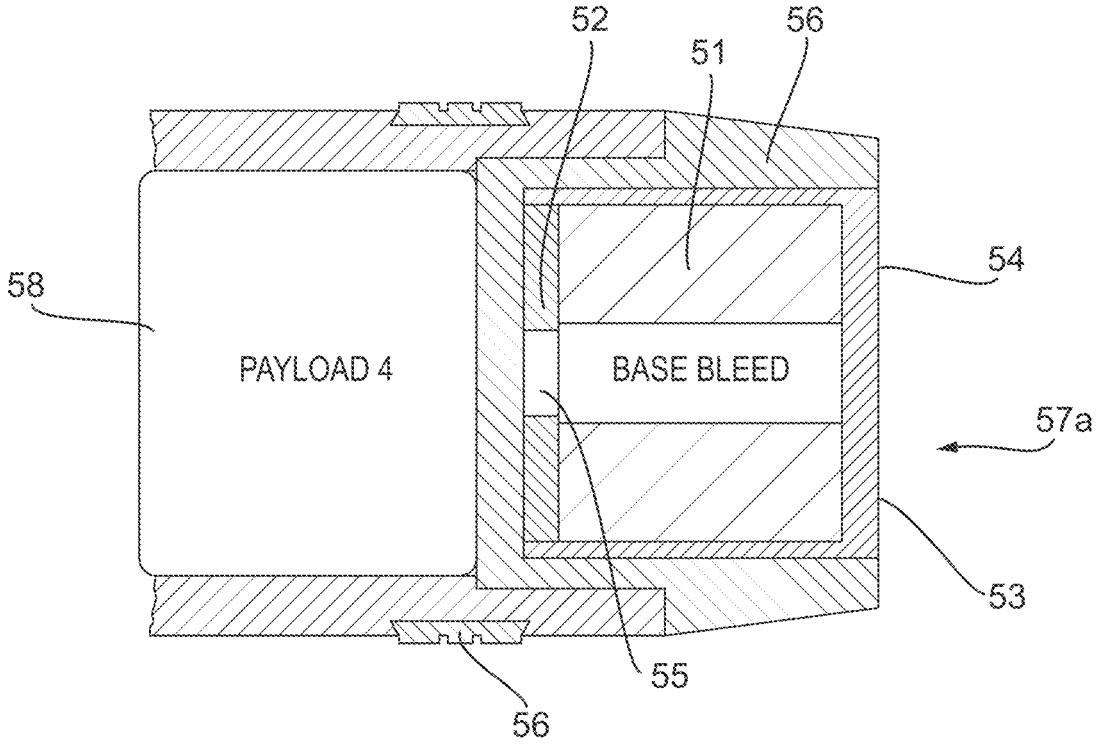
FIG. 6 shows the base bleed in the inert configuration.

Turning to FIG. 6 there is a section of the rear of the shell 58 with a modular payload, showing the base bleed unit 57*a* in the housing 56 in the inert orientation.

The first end 52 of base bleed device 57*a* comprises an aperture 55 which is directed towards the housing 56 and the main body of the shell. Thereby upon ignition of the main charge propellant, the hot gases and particulates cannot cause the ignition of the base bleed composition 51. The closed end 54, of the second end 53, faces the main propellant charge (not shown). The closed end 54 or the closed end 54 and housing 56 together may form a boat tail configuration.

The driving band 46 is located towards the rear of the shell body, so as to impart spin to the shell upon gun launch The base bleed unit 57 in the active orientation may be detached from the housing 56, turnaround to locate it in the inert orientation 57*a* or vice versa.

Figure 7:
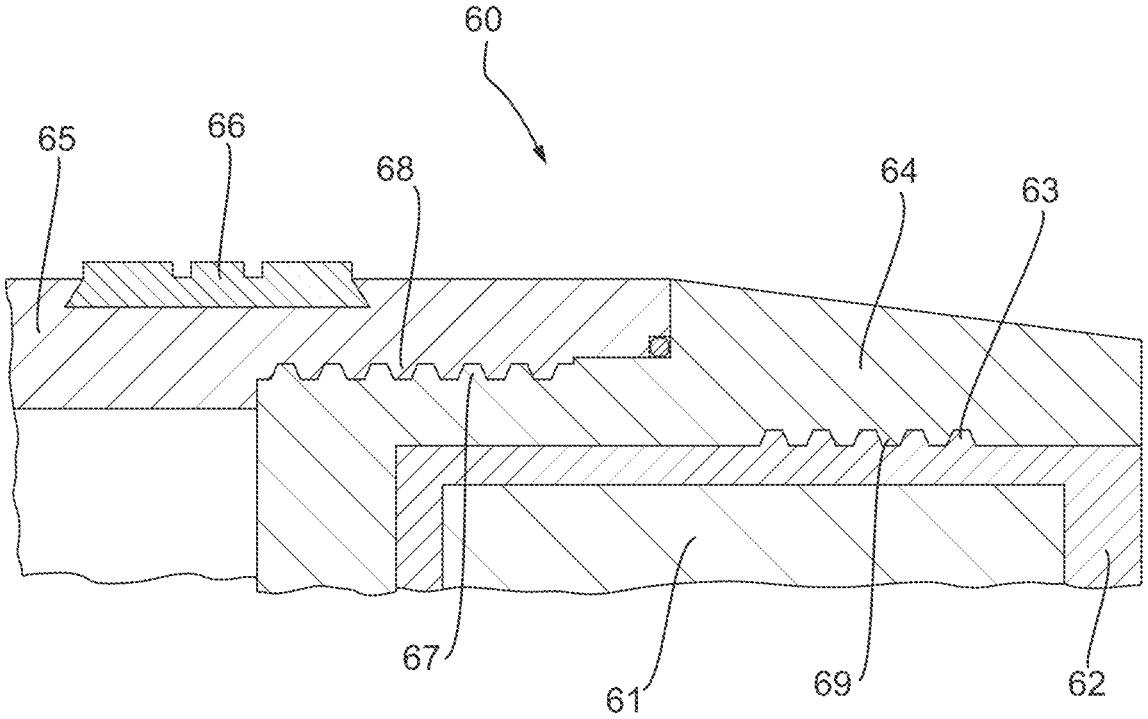
FIG. 7 shows a section of the base bleed reversibly engaged via a threaded connector to the shell body

Turning to FIG. 7, there is provided a section of the base bleed device 60, showing a section of the shell body 65 and driving band 66. The base bleed device housing 64 is reversibly engaged with the shell body 65 by co-operative threads 67, 68. This allows the housing 64 to be removed from the shell 65, to allowing loading of the payload (not shown). The base bleed device 62 is reversibly engaged with the housing 64, by co-operative threads 64, 69. This allows the base bleed device 62 to be removed from a first inert orientation and quickly turned around ie reversed to a second active orientation, as shown in FIG. 6. The base bleed device 62 comprises a gas generator composition 61.

The co-operative threads may be replaced by shear pins or other fasteners.

The invention claimed is:

1. A reversible range extension device, capable in use, of being reversibly engaged to a body of an artillery shell, said range extension device comprising:

at least one energetic material;

an igniter;

a first end with an aperture; and a second end that is closed;

wherein the range extension device, in use, is selectively arranged to be in an active orientation or inert orientation, and wherein in the active orientation the range extension device is arranged such that the aperture faces rearwardly away from the shell to allow the range extension device to function, and in the inert orientation the range extension device is arranged such that the aperture faces inwardly towards the shell.

2. The range extension device according to claim 1, wherein the range extension device is a base bleed.

3. The range extension device according to claim 2, wherein the range extension device reversible engagement comprises co-operative threads on the range extension device and the shell body.

4. The range extension device according to claim 1, wherein a body of the range extension device is manufactured from high-strength tempered steel, titanium, fibre reinforced composite, or aluminium alloy.

5. The range extension device according to claim 1, wherein the range extension device is located in a housing, wherein the housing is reversibly attached, in use, to the shell body, and wherein the range extension device is selectively positioned within the housing in the inert orientation or active orientation.

6. The range extension device according to claim 5, wherein the range extension device reversible engagement comprises co-operative threads on the range extension device and the housing.

7. The range extension device, according to claim 1, wherein in the second end is shaped as a boat tail.

8. An artillery shell comprising:

a main shell body, a fuze, and located therebetween an ogive portion, said main shell body and ogive section forming a payload cavity, said cavity capable of receiving a payload, wherein at rearward of the main shell body is the reversible range extension device according to claim 1.

9. The shell according to claim 8, wherein the range extension device is located in a housing, wherein the housing is reversibly attached to the shell body, and wherein the range extension device is selectively positioned within the housing in the inert or active orientation.

10. A reversible base bleed device, capable in use of being reversibly engaged to a body of an artillery shell, said base bleed device comprising:

at least one energetic material charge;

an igniter;

a first end with an aperture; and a second end that is closed;

wherein the base bleed device in an active orientation has the aperture facing rearwardly away from the shell to allow the base bleed to function, and wherein the base bleed device in an inert orientation has the aperture facing inwardly towards the shell to provide a boat tail.

11. The base bleed device according to claim 10, wherein a body of the base bleed device is manufactured from high-strength tempered steel, titanium, fibre reinforced composite, or aluminium alloy.

12. The base bleed device according to claim 10, wherein the base bleed device reversible engagement comprises co-operative threads on the range extension device and the shell body.

13. The base bleed device according to claim 10, wherein the base bleed device is located in a housing, wherein the housing is reversibly attached, in use, to the shell body, and wherein the base bleed device is selectively positioned within the housing in the inert orientation or active orientation.

14. The base bleed device according to claim 13, wherein the base bleed device reversible engagement comprises co-operative threads on the base bleed device and the housing.

15. An artillery shell comprising:

a main shell body, a fuze, and located therebetween an ogive portion, said main shell body and ogive section forming a payload cavity, said cavity capable of receiving a payload, wherein at rearward of the main shell body is the reversible base bleed device according to claim 10.

16. A reversible range extension device, capable in use, of being reversibly engaged to a body of an artillery shell, said range extension device comprising:

at least one energetic material;

an igniter;

a first end with an aperture; and a second end that is shaped as a boat tail;

wherein the range extension device, in use, is selectively arranged to be in an active orientation or inert orientation, and wherein in the active orientation the range extension device is arranged such that the aperture faces rearwardly away from the shell to allow the range extension device to function, and in the inert orientation the range extension device is arranged such that the aperture faces inwardly towards the shell.

17. The range extension device according to claim 16, wherein the range extension device is a base bleed.

18. The range extension device according to claim 16, wherein a body of the range extension device is manufactured from high-strength tempered steel, titanium, fibre reinforced composite, or aluminium alloy.

19. The range extension device according to claim 16, wherein the range extension device reversible engagement comprises co-operative threads on the range extension device and the shell body.

20. The range extension device according to claim 16, wherein the range extension device is located in a housing, wherein the housing is reversibly attached, in use, to the shell body, and wherein the range extension device is selectively positioned within the housing in the inert orientation or active orientation, and wherein the range extension device reversible engagement comprises co-operative threads on the range extension device and the housing.

* * * * *